United States Patent [19]

Binder et al.

[11] 4,184,611

[45] Jan. 22, 1980

[54] METHOD OF AUTOMATICALLY TAKING IN A FIBRE LAYER IN BLOW-ROOM MACHINES AND APPARATUS FOR IMPLEMENTING THE METHOD

[75] Inventors: Rolf Binder, Raterschen; Paul Staheli, Wilen b. Wil, both of Switzerland

[73] Assignee: Rieter Machine Works Limited, Winterthur, Switzerland

[21] Appl. No.: 922,814

[22] Filed: Jul. 10, 1978

[30] Foreign Application Priority Data

Jul. 18, 1977 [CH] Switzerland ..... 8848/77

[51] Int. Cl.[2] ..... B67D 5/08

[52] U.S. Cl. ..... 222/1; 222/63; 222/70; 222/313; 19/239; 131/108

[58] Field of Search ..... 222/1, 52, 55, 64–66, 222/70, 63, 410, 414, 415, 310–314, 316; 19/239, 240, 105; 131/108, 109 R

[56] References Cited

U.S. PATENT DOCUMENTS

| | | | |
|---|---|---|---|
| 2,911,684 | 11/1959 | Hunter | 19/203 |
| 3,858,759 | 1/1975 | Lubenow | 222/414 |

*Primary Examiner*—H. Grant Skaggs

*Attorney, Agent, or Firm*—Werner W. Kleeman

[57] ABSTRACT

A method and apparatus for taking-in a fibre layer in blow-room machines wherein the fibre layer is pressed by a number of pivotable pedal levers distributed across the width of the machine, and loaded by a pressing device, against a take-in roll. In the absence of fibre material between the take-in roll and the pedal levers, the pedal levers are temporarily lifted-off the take-in roll.

6 Claims, 2 Drawing Figures

METHOD OF AUTOMATICALLY TAKING IN A FIBRE LAYER IN BLOW-ROOM MACHINES AND APPARATUS FOR IMPLEMENTING THE METHOD

BACKGROUND OF THE INVENTION

The present invention concerns a new and improved method of, and apparatus for, automatically taking-in a fibre layer in blow-room machines, wherein the fibre layer is pressed by a number of pivotable pedal levers distributed across the width of the machine, and loaded by a pressing device, against a take-in roll.

Now from German Pat. No. 1,091,011 and the corresponding U.S. Pat. No. 2,911,684 a device is known to the art wherein loose fibre material which is supplied from a transporting duct is placed against a roll using spring-loaded pedal levers. The pedal levers in this arrangement form a wedge-shaped take-in gap. If no material is present between the pedal levers and the roll, the gap closes to such an extent that further material which is subsequently supplied only can be taken-in or delivered into the narrow gap with extreme difficulties.

U.S. Pat No. 3,780,399 teaches a further prior art device wherein the pedal levers are provided with cams or stops in such a manner that the wedge-shaped gap does not close-up smaller than a minimum width.

These state-of-the-art devices have the disadvantage that after an interruption of the fibre supply, or if the material is changed, the taking-in of freshly supplied material into the wedge-shaped gap between the pedal lever and the take-in roll is not ensured and is left more or less to chance. If the taking-in operation does not occur automatically, then the fibre layer has to be taken-in manually between the pedal levers and the take-in roll. This operation is complicated and dangerous, and furthermore, causes unfavourably long machine downtime.

SUMMARY OF THE INVENTION

Hence, it is a primary object of the present invention to provide a new and improved method of, and apparatus for, automatically taking-in a fibre layer in blow-room machines in a manner not associated with the aforementioned drawbacks and limitations of the prior art proposals.

Another important object of the present invention is to devise a method and apparatus which insures, at all times, for reliable taking-in of the fibre layer between the feed roll and the pedal levers.

Still a further significant object of the present invention is to provide a new and improved method of, and apparatus for, automatically taking-in a fibre layer in blow-room machines in an extremely positive and reliable manner, which apparatus is relatively simple in construction and design, economical to manufacture, not readily subject to breakdown or malfunction and requires a minimum of maintenance and servicing.

Now in order to implement these and still further objects of the invention, which will become more readily apparent as the description proceeds, the method aspects of the present development are manifested by the features that the pedal levers are temporarily lifted-off the take-in roll in the absence of material between the take-in roll and the pedal levers.

Not only is the invention concerned with the aforementioned method aspects, but also relates to new and improved apparatus for the implementation thereof, which apparatus comprises a fibre supply device, a take-in roll, a number of pedal levers arranged across the width of the take-in roll, and a pressing device for pressing the pedal levers against the take-in roll. According to important aspects of the invention there is provided a feeler element which, in the absence of fibre material, detects the end position of the pedal levers and activates a control device which deactivates the pressing device of the pedal levers.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic cross-sectional view of the take-in zone of a blow-room machine during the taking-in of the fibres or the like.

DETAILED DESCRIPTION OF THE PREFERRED EMBODIMENTS

Figure 1:
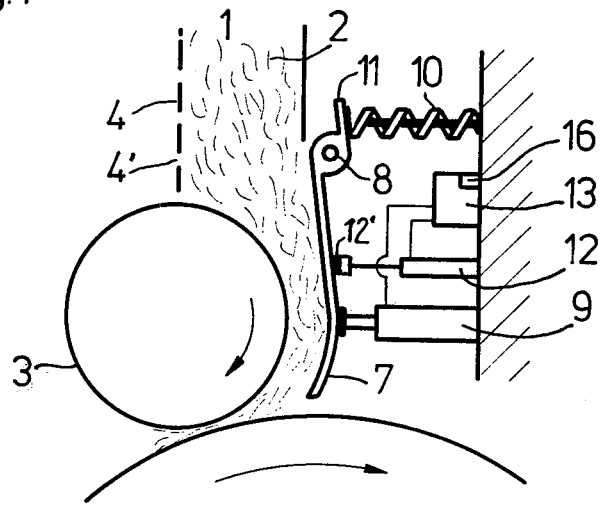
Figure 2:
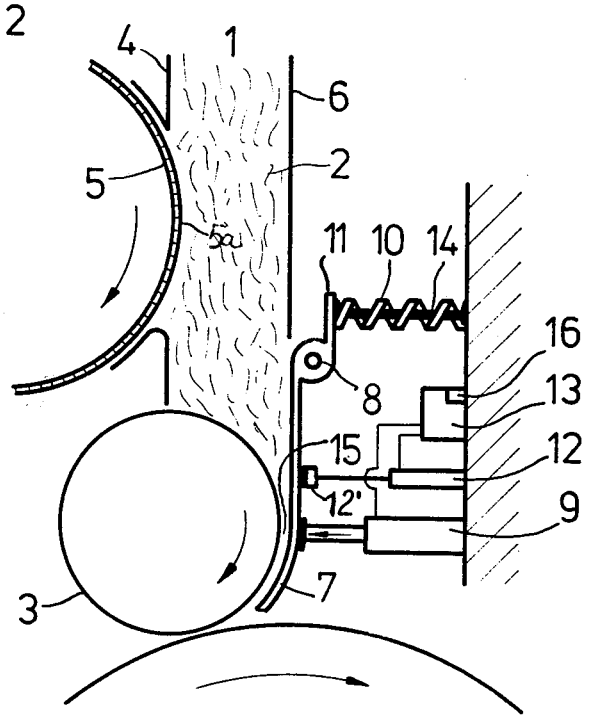
FIG. 2 is a cross-sectional view, similar to the showing of FIG. 1, but in the absence of fibre material in the take-in zone.

Describing now the drawings, it is to be understood that only enough of the textile machine has been shown to enable those skilled in the art to readily understand the underlying principles and concepts of the invention and to simplify the showing of the drawings. Turning attention to FIG. 1, it will be recognized that a conventional and therefore not particularly illustrated fibre opening machine supplies a fibre and air mixture to a duct of chute 1, with the fibres 2 reaching a take-in or feed roll 3 dispositioned at the lower end of the chute or duct 1.

The entrained transporting air can escape either via perforations or slots 4' provided in the chute wall 4 and/or via the shell or sleeve 5*a* of a rotating perforated drum 5, which protrudes somewhat into the chute or duct 1. The fibres 2 separated from the transporting air are deposited above the feed or supply roll 3 in the chute 1. The opposite wall 6, facing the chute or duct wall 4, is provided at the lower chute end with a pivotable extension whih extends tangentially with respect to the feed roll 3, in the form of so-called pedal levers 7, which are distributed across the width of the machine. To simplify the illustration only one such pedal lever 7 is visible, but it will be understood that others are arranged in tandem along the machine width. The pedal levers 7 are supported on the chute side on an axle or shaft 8 which extends parallel to the feed roll 3, and are pressed against the feed roll 3 by a pressing or pressure device 9. The pressing device 9 can be activated pneumatically, hydraulically or electrically. In a direction opposite to the action of the pressure device 9, a helical spring 10 or equivalent structure acts on the protrusions or noses 11 of the pedal levers 7 and lifts the pedal levers 7 off the feed roll 3 when the pressure exerted by the pressing device 9 is absent. By suitably choosing the length of a bolt 14 extending along the axis of the helical spring 10, the pivoting range of the pedal lever 7 can be limited to a degree such that the pedal levers 7 cannot touch the feed roll 3.

Furthermore, there is provided a feeler means in the form of a limit switch 12 which contacts the pedal levers 7. The limit switch 12 is provided with a contacting rod 12′ extending parallel to the feed roll 3 and across the whole width of the pedal lever zone. The limit switch 12 is activated, if all pedal levers 7 almost contact the feed roll, i.e. if no more fibre material is present, or is taken-in. The limit switch 12 is connected with a control device or means 13 containing a built-in timing device, which activates the pressing device 9.

The apparatus described above functions in the following manner:

The fibre material 2 supplied by an opening machine in the form of a fibre and air stream is separated from the transporting air in the chute 1 and is deposited in the form of a flock column. During normal operation the fibre material is continuously carried or drawn into the wedge-shaped gap 15 between the pedal levers 7 and the feed roll 3 and is transferred by the feed roll 3 to the next processing stage (e.g. an opening roll of a blow-room machine).

It now can occur that after a change of material or after an interruption of the supply the chute runs empty in such a manner that no more fibre material is present in the gap 15. The pedal levers 7 in this case pivot toward the feed roll 3 in such a manner that the gap 15 is narrowed to such an extent that freshly supplied fibres 2 no longer are automatically taken-in. If this situation occurs, then the limit switch 12 now is activated and transmits a signal to the control device 13 which, in turn, effects a diminuation or a deactivation of the pressure exerted by the pressing device 9. The pedal levers 7 are pivoted back by the spring 10 in such a manner that fibres 2 can again penetrate into the now opened gap 15. As soon as the pedal levers 7 are again loaded, the fibres 2 are automatically taken-in. The duration of the opening of the gap 15, i.e., the duration of the reduced or de-activated pressure action of the pedal levers 7 can be pre-set by an adjustable timing relay 16 in the control device 13, which duration depends upon the type of fibre material processed and also upon the cross-section of the taking-in zone.

It also has proven advantageous if, during the standstill of the feed roll 3, the pedal levers 7 are lifted-off and are again pressed against the feed roll 3 only after a time delay following the start-up of the feed roll 3.

The inventive apparatus is of very simple design. The simple control of the pedal lever by means of a limit switch and a timing relay ensures for a disturbance-free taking-in of the fibre material into the blow-room machine.

A further notable advantage is that, the pedal levers and the feed roll are not worn out in the absence of fibre material.

While there are shown and described present preferred embodiments of the invention, it is to be distinctly understood that the invention is not limited thereto, but may be otherwise variously embodied and practiced within the scope of the following claims. Accordingly,

What we claim is:

1. A method of taking-in a fibre layer in blow-room machines, comprising the steps of:
   - providing a number of pivotable pedal levers distributed across the width of the machine and loaded by a pressing device;
   - providing a take-in roll;
   - pressing the fibre layer by means of said number of pivotable pedal levers against the take-in roll; and
   - temporarily lifting-off the pedal levers from the take-in roll in response to the absence of fibre material between the take-in roll and the pedal levers.

2. The method as defined in claim 1, further including the steps of:
   - providing a timing relay that presets a time delay during which the pedal levers are temporarily lifted-off the take-in roll.

3. The method as defined in claim 1, further including the steps of:
   - lifting-off the pedal levers from the take-in roll during standstill of said take-in roll.

4. An apparatus for taking-in a fibre layer in a blow-room machine, comprising:
   - a fibre supply duct;
   - a take-in roll positioned to cooperate with said fibre supply duct;
   - a number of pedal levers arranged across the width of the take-in roll;
   - a pressing device for pressing the pedal levers towards the take-in roll;
   - feeler means cooperating with said pedal lever;
   - control means cooperating with said pressing device;
   - said feeler means detecting an end position of said pedal levers in the absence of fibre material and activating said control means in order to deactivate the pressing device of said pedal levers.

5. The apparatus as defined in claim 4, wherein: said control means comprises a timing relay which controls the activation of the control means over a set time period.

6. The apparatus as defined in claim 5, wherein:
   - said timing relay comprises adjustable timing relay means having a presettable time delay.

* * * * *